US005525038A

United States Patent [19]

Sharma et al.

[11] Patent Number: 5,525,038

[45] Date of Patent: Jun. 11, 1996

[54] ROTOR AIRFOILS TO CONTROL TIP LEAKAGE FLOWS

[75] Inventors: Om P. Sharma, Vernon; Joseph B. Staubach, Colchester; Gary Stetson, Tolland, all of Conn.

[73] Assignee: United Technologies Corporation, Hartford, Conn.

[21] Appl. No.: 334,301

[22] Filed: Nov. 4, 1994

[51] Int. Cl.[6] ..... F01D 5/20

[52] U.S. Cl. ..... 416/238; 416/223 A; 416/235

[58] Field of Search ..... 416/223 A, 228, 416/235, 238, 243

[56] References Cited

U.S. PATENT DOCUMENTS

| | | | |
|---|---|---|---|
| 2,714,499 | 8/1955 | Warner | 416/228 |
| 4,682,935 | 7/1987 | Martin | 416/223 A |
| 5,088,892 | 2/1992 | Weingold et al. . | |
| 5,167,489 | 12/1992 | Wadia et al. | 416/223 A |

*Primary Examiner* Edward K. Look
*Assistant Examiner* Christopher Verdier
*Attorney, Agent, or Firm* Marina F. Cunningham

[57] ABSTRACT

A rotor blade for a gas turbine engine includes a bowed surface on a tip region of the suction side thereof. The curvature of the bowed surface progressively increases toward the tip of the blade. The bowed surface results in a reduction of tip leakage through a tip clearance from the pressure side to the suction side of the blade and reduces mixing loss due to tip leakage.

6 Claims, 2 Drawing Sheets

*fig. 1*
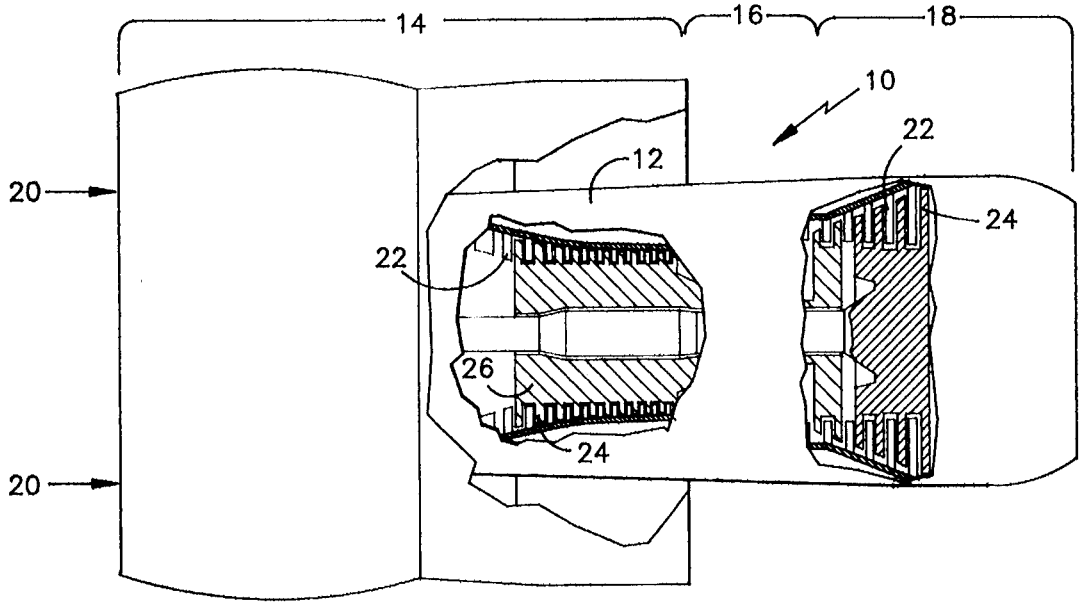
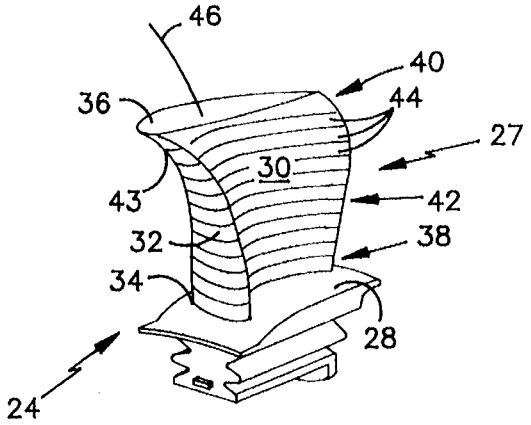
*fig. 2*
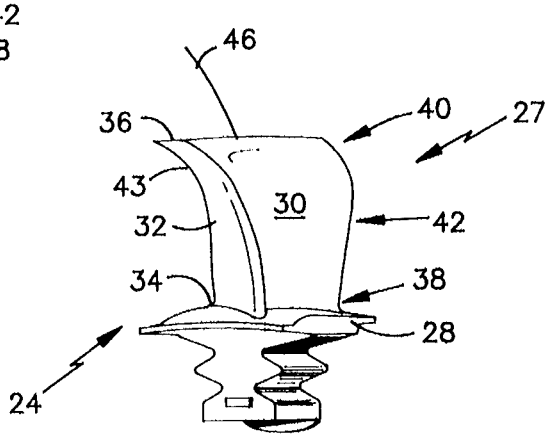
*fig. 3*

ROTOR AIRFOILS TO CONTROL TIP LEAKAGE FLOWS

TECHNICAL FIELD

This invention relates to gas turbine engines and, more particularly, to rotating airfoils therefor.

BACKGROUND ART

Conventional gas turbine engines are enclosed in an engine case and include a compressor, a combustor, and a turbine. An annular flow path extends axially through the sections of the engine. As is well known in the art, the compressor includes alternating rows of stationary airfoils (vanes) and rotating airfoils (blades) that apply force to compress the incoming working medium. A portion of the compressed working medium enters the combustor where it is mixed with fuel and burned therein. The products of combustion or hot gases then flow through the turbine. The turbine includes alternating rows of stationary vanes and rotating blades that extend radially across the annular flow path and expand the hot gases to extract force therefrom. A portion of the extracted energy is used to drive the compressor.

Each airfoil includes a low pressure side (suction side) and a high pressure side (pressure side) extending radially from a root to a tip of the airfoil. To optimize efficiency, the annular flow path for the working medium is defined by an outer shroud and an inner shroud. The inner shroud is typically formed by a plurality of platforms that are integral to the airfoils and that mate with each other. The outer shroud is typically the engine case disposed radially outward of the outer tips of the rotating blades. A tip clearance is defined between the engine case and the tips of the rotating blades.

One of the major goals in gas turbine engine fabrication is to optimize efficiency of the compressor and the turbine so that work is not lost. Although 100% efficiency is ideal, current turbines and compressors operate at approximately 85–90% efficiency, thus loosing approximately 10–15% in potential work. For both the turbines and the compressors, approximately 20–30% of the lost work, or 2–5% of the total efficiency is lost due to tip leakage losses.

Tip leakage occurs when higher pressure air from the pressure side of the rotor blade leaks to the lower pressure suction side of the blade through the tip clearance. The tip leakage reduces efficiency in two ways. First, the work is lost when the higher pressure gas escapes through the tip clearance without being operated on in the intended manner by the blade, i.e. for compressors the leakage flow is not adequately compressed and for the turbines the leakage is not adequately expanded. Second, the leakage flow from the pressure side produces interference with the suction side flow. The interference results from the leakage flow being misoriented with respect to the suction side flow. The difference in the orientation and velocity of the two flows results in a mixing loss as the two flows merge and eventually become uniform. Both types of losses contribute to reduction in efficiency.

During the operational life of the gas turbine engine, the problem of the tip leakage worsens because the tip clearance between the blade tip and the engine case increases with time and thereby allows more flow to leak therethrough. The tip clearance increases primarily because of two reasons. First, during transient operation of the gas turbine engine the blade tips can grind into the stationary engine case. Second, din particles contained in the large volumes of air that pass over the blades are centrifuged towards the rotating blade tips and cause considerable erosion of the tips. In both situations, the tip clearance increases permanently, thereby resulting in greater tip leakage and greater efficiency losses.

The problem of tip leakage has been investigated for many years and no effective and practical solution has been found other than reducing the tip clearances. Most current solutions involve active changing of the tip clearance by adjusting the diameter of the engine case liner. However, the active control of the tip clearance requires additional hardware that adds complexity and undesirable weight to the engine. Thus, there is a great need to reduce tip leakage in gas turbine engines without including a significant weight and cost penalties.

DISCLOSURE OF THE INVENTION

It is an object of the present invention to increase gas turbine engine efficiency.

It is a further object of the present invention to reduce adverse effects of tip leakage on a gas turbine engine performance.

According to the present invention, a rotor blade for a gas turbine engine having a pressure side and a suction side includes a bowed surface on a tip region of the suction side thereof, to shift airflow away from a tip clearance defined between the tip of the rotor blade and an engine case, thereby reducing the adverse effect of the tip leakage on gas turbine engine performance. The bowed surface has an arcuate shape to produce the greatest amount of curvature at the tip of the blade.

The gas turbine engine efficiency is increased as the bowed surface deflects the airflow away from the tip clearance, thereby reducing the tip leakage through the tip clearance and mixing loss between the leaked air and the free flow air on the suction side. The bowed surface results in an increasingly greater radially downward component of the normal (body) force acting on the bowed surface. The radial component of the body force on the suction side shifts the airflow away from the tip region of the suction side toward the midspan region of the suction side. This redirection of the airflow increases the local pressure at the tip region of the suction side and reduces the local pressure at the midspan region of the suction side of the airfoil. The increase in the local pressure at the tip region of the suction side reduces the pressure difference between the tip region of the suction side and the tip region of the pressure side. The reduction in the pressure difference between the suction side and the pressure side reduces the tip leakage from the pressure side to the suction side through the tip clearance. Furthermore, the smaller pressure difference between the pressure side flow and the suction side flow reduces the losses in performance due to the mixing loss, since the two flows merge and become uniform faster.

One advantage of the present invention is that the degree of curvature is highest at the tip and thus minimizes the mass of an airfoil that is offset from the radial line, thereby minimizing the stress on the rotor blade.

The foregoing and other objects and advantages of the present invention become more apparent in light of the following detailed description of the exemplary embodiments thereof, as illustrated in the accompanying drawings.

BRIEF DESCRIPTION OF THE DRAWINGS

FIG. 1 is a simplified, partially broken away elevation of a gas turbine engine;

FIG. 2 is an enlarged, perspective view of a bowed rotor blade of the gas turbine engine of FIG. 1, according to the present invention;

FIG. 3 is a side elevation of the bowed rotor blade of FIG. 2;

BEST MODE FOR CARRYING OUT THE INVENTION

Figure 5:
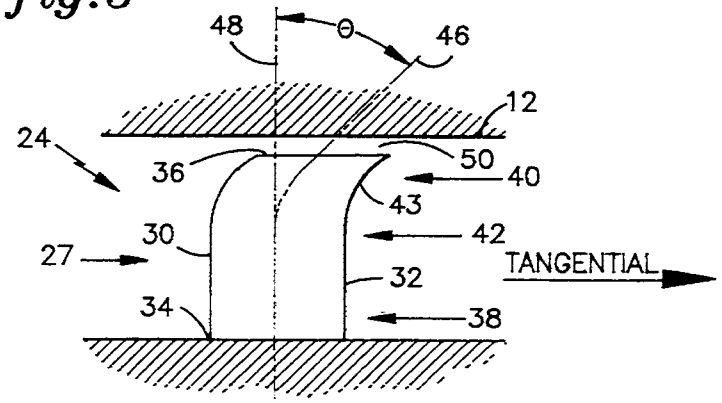
FIG. 5 is a diagrammatic side view of the rotor blade of FIG. 4.

Referring to FIG. 1, a gas turbine engine 10 is enclosed in an engine case 12 and includes a compressor 14, a combustor 16, and a turbine 18. Air 20 flows axially through the sections 14, 16, 18 of the engine 10. As is well known in the art, the air 20, compressed in the compressor 14, is mixed with fuel which is burned in the combustor 16 and expanded in the turbine 18, thereby rotating the turbine 18 and driving the compressor 14.

The compressor 14 and the turbine 18 comprise alternating rows of stationary airfoils, or vanes 22, and rotating airfoils, or blades 24. The blades 24 are secured in a rotor disk 26.

Referring to FIGS. 2 and 3, each blade 24 comprises an airfoil portion 27 and a platform 28 that is integrally attached to the airfoil portion 27 and secures the blade 24 onto the rotor disk 26. Each airfoil portion 27 includes a pressure side 30 and a suction side 32 extending from a root 34 to a tip 36. The airfoil portion 27 of each blade has a root region 38 at the root 34, a tip region 40 at the tip 36, and a mid-span region 42 therebetween. The tip region 40 of the suction side 32 has a bowed surface 43 with an arcuate shape. The arcuate shape of the bowed surface 43 has progressively increasing curvature toward the tip 36 of the rotor blade 24, so that a radial component of a normal to the suction side bowed surface 43 becomes progressively larger toward the tip 36.

Figure 4:
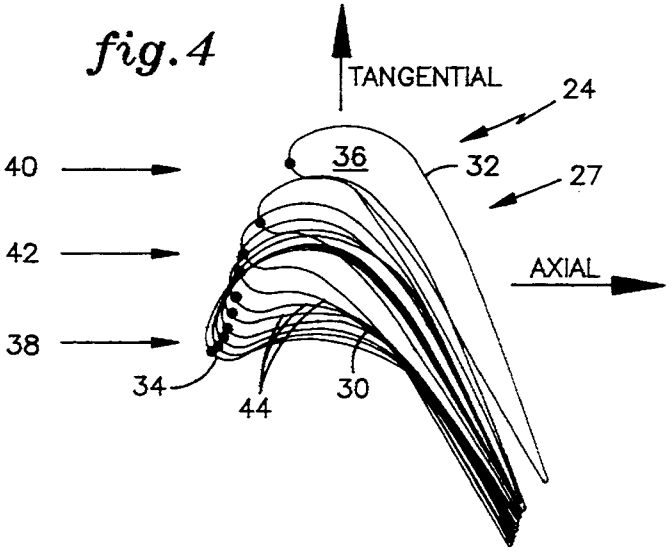
FIG. 4 is a plan view of FIG. 3.
Figure 6:
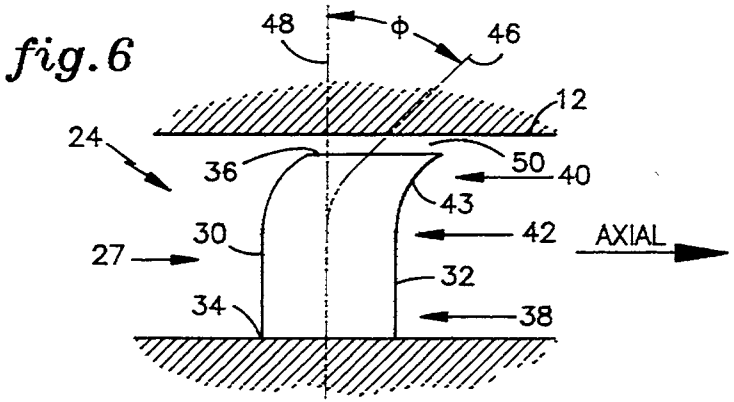
FIG. 6 is a diagrammatic front view of the rotor blade of FIG. 4.

Each region 38, 40, 42 of the blade 24 comprises a plurality of airfoil sections 44 stacked radially along a generally spanwise stacking line 46. The stacking line 46 has an arcuate shape at the tip region 40 thereof, as shown in FIG. 5, to achieve the bowed surface on the suction side of the airfoil 24. The stacking line begins to deviate from the radial direction, designated by a radial line 48, between 55% and 75% of the span from the root 34. The stacking line is bowed in the tangential direction and in the axial direction, as shown in FIGS. 4–6. The stacking line 46 and the radial line 48 form a bow angle $\theta$ that is between 20° and 60° in tangential direction, as shown in FIG. 5. The stacking line 46 and the radial line 48 form a bow angle $\phi$ that is between 20° and 60° in axial direction, as shown in FIG. 6. The stacking line 46 in the tip region is a curve of at least second degree, such as a parabola or a circle. The arcuate shape of the stacking line 46 results in the airfoil sections 44 being offset at the tip region 40 of the suction side 32 to form the bowed surface 43. As shown in FIGS. 5 and 6, a tip clearance 50 is formed between the tips 36 of the blades 24 and the engine case 12.

During operation of the gas turbine engine 10, as the air is compressed in the compressor 14 and expanded in the turbine 18, the air pressure on the pressure side 30 is higher than the air pressure on the suction side 32. The body forces or pressure field around the airfoil 24 is normal to the surfaces on the suction side 32 and the pressure side 30. In the conventional, radially oriented airfoil, the pressure field is substantially normal to the radial direction and to the radially oriented stacking line and thus, comprises relatively small radial component. In the blade 24 of the present invention, the pressure field or body forces of the bowed surface 43 are normal to that bowed surface 43. With increasing curvature of the bowed surface toward the tip 36 of the blade, the radially downward component of the body force progressively increases toward the tip 36. The body forces frown the bowed surface 43 are imparted onto the working medium flowing around each airfoil. The radially downward component of the body force at the tip of the suction side 32 of the blade 24 deflects the flow of the working medium away from the tip region 40 toward the midspan region 42 on the suction side 32 of the airfoil 24. The deflected airflow reduces interference with the air that is leaked from the pressure side 30 to the suction side 32 through the tip clearance 50, thereby reducing mixing loss and thus, increasing the engine efficiency.

As the bowed surface 43 reorients body forces and pushes the flow away from the tip region 40 of the suction side 32, the local pressures acting on the airfoil 24 are also readjusted. The bowed surface 43 results in increased pressure at the tip region 40 of the suction side 32 and in lower pressure at the midspan region 42 of the suction side 32, as compared to a conventional blade without the bowed surface. The increase in pressure at the tip region 40 of the suction side 32 reduces the pressure differential between the tip region 40 of the pressure side 30 and the tip region 40 of the suction side 32. This reduction in the pressure differential reduces the amount of air flow leaking from the pressure side 30 to the suction side 32 through the tip clearance 50. The reduction in the amount of airflow leaked through the tip clearance reduces the amount of air that escapes without being expanded by the turbine blades or without being compressed by the compressor blades. Since smaller amount of air escapes through the tip clearance without performing work, the efficiency of the gas turbine engine is improved. Additionally, the smaller pressure differential between the pressure side and the higher pressure at the tip region of the suction side reduces lost efficiency due to the mixing loss. The leaked air from the pressure side and the suction side flow are able to become uniform in a shorter period of time, thereby reducing lost efficiency due to the mixing loss.

Although bowed stationary vanes have been described in U.S. Pat. No. 5,088,892 to Weingold et al entitled "Bowed Airfoil for the Compressor Section of a Rotary Machine", the bowed airfoil technology was not previously used for rotating blades. The rotating blades are inherently different from the stationary vanes because the rotating blades are subjected to high stresses produced by the centrifugal forces. By localizing the bow to the tip, the amount of mass of the rotor blade that is offset from the conventional radial direction is minimized. Excessive mass offset from the radial direction would produce undesirable stresses in rotating blades. By limiting the bow to the tip of the blade, the excessive offset is avoided. Additionally, the bowed tip region of the present invention implements the bowed surface by having a progressively greater curvature toward the tip. This feature further reduces the amount of mass of the airfoil that is offset.

Figure 7:
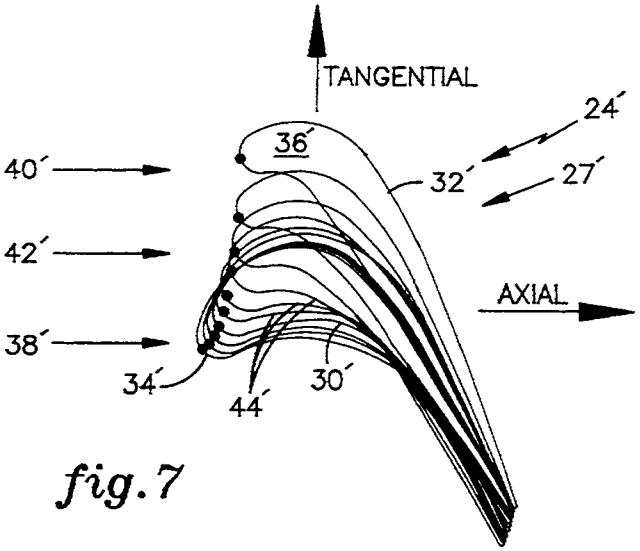
FIG. 7 is a plan view of another embodiment of the present invention.

An alternate embodiment of the present invention is shown in FIG. 7. The bowed surface 43' of the blade 24' is bowed in the tangential direction only and does not include a bow in the axial direction.

Although the invention has been shown and described with respect to exemplary embodiments thereof, it should be understood by those skilled in the art that various changes, omissions, and additions may be made thereto, without departing from the spirit and scope of the invention.

We claim:

1. A gas turbine engine rotor blade having a pressure side and a suction side spanning from a root to a tip, said rotor blade having a leading edge and a trailing edge, said rotor blade having a root region, a mid-span region and a tip region stacked radially from said root to said tip, said rotor blade being secured within a rotor disk and enclosed in an engine case, a tip clearance being defined between said tips of said rotor blades and said engine case, said rotor blade characterized by:

a bowed surface formed at said tip region extending from said leading edge to said trailing edge of said suction side of said rotor blade to redirect airflow on said suction side away from said tip region toward said midspan region so that the adverse effect of tip leakage through said tip clearance is reduced, said bowed surface leaning toward said suction side of said rotor blade.

2. The rotor blade according to claim 1, further characterized by said bowed surface having at least second degree curvature at said tip region of said blade to result in a greatest amount of curvature at said tip of said blade.

3. The rotor blade according to claim 1, further characterized by said bowed surface having an arcuate shape at said tip region of said blade to result in a greatest amount of curvature at said tip of said blade.

4. The rotor blade according to claim 1, further characterized by said bowed surface of said rotor blade beginning at 55%–75% of the span of said rotor blade from said root.

5. The rotor blade according to claim 4, further characterized by said rotor blade being bowed 20°–60° in a tangential direction.

6. The rotor blade according to claim 5, further characterized by said rotor blade being bowed 20°–60° in an axial direction.

* * * * *